United States Patent [19]

Begg et al.

[11] Patent Number: 4,859,542

[45] Date of Patent: Aug. 22, 1989

[54] GRADED STRUCTURE COMPOSITES

[75] Inventors: Alan R. Begg, Ascot; Colin W. Brown, Windsor; Neil E. S. Charman, Bracknell, all of United Kingdom

[73] Assignee: The British Petroleum Company p.l.c., London, England

[21] Appl. No.: 91,788

[22] Filed: Sep. 1, 1987

[30] Foreign Application Priority Data

Sep. 18, 1986 [GB] United Kingdom ..... 8622464

[51] Int. Cl.[4] ..... B22F 7/04; B32B 15/16

[52] U.S. Cl. ..... 428/547; 428/557; 428/565

[58] Field of Search ..... 428/547, 557, 565

[56] References Cited

U.S. PATENT DOCUMENTS

| | | |
|---|---|---|
| 2,275,420 | 3/1942 | Clark et al. . |
| 3,800,380 | 4/1974 | Cline et al. . |
| 3,816,112 | 6/1974 | Heck . |
| 4,101,712 | 7/1978 | Bomford et al. . |
| 4,198,233 | 4/1980 | Frehn . |
| 4,359,335 | 11/1982 | Garner . |
| 4,368,788 | 1/1983 | Drake . |
| 4,372,404 | 2/1983 | Drake . |
| 4,398,952 | 8/1983 | Drake . |
| 4,595,067 | 7/1986 | Drake . |
| 4,610,931 | 9/1986 | Nemeth et al. . |

FOREIGN PATENT DOCUMENTS

| | | |
|---|---|---|
| 0111600 | 4/1982 | European Pat. Off. . |
| 0052584 | 6/1982 | European Pat. Off. . |
| 1483420 | 10/1972 | Fed. Rep. of Germany . |
| 659765 | 10/1954 | United Kingdom . |
| 911461 | 11/1962 | United Kingdom . |
| 1525290 | 9/1978 | United Kingdom . |

OTHER PUBLICATIONS

H. E. Sanderson et al., "High Strength 4100 Alloy PM Steels", Metal Powder Report, vol. 41, (6), Jun. 1986, pp. 423–427.

A. H. Cottreee, "An Introduction to Metallurgy", published by Edward Arnold, (1985), pp. 376–377 and 380–383.

A. M. Cottenden et al., "Hard Metal Interlayered Butt-Joints Made by Diffusion Bonding", Metals Technology, Jun. 1981, pp. 221–233.

*Primary Examiner*—Stephen J. Lechert, Jr.
*Assistant Examiner*—Eric Jorgensen
*Attorney, Agent, or Firm*—Nixon & Vanderhye

[57] ABSTRACT

This case relates to tough, wear resistant graded structure composites, to a process for preparing the same and to tools and products fabricated therefrom. The composites have a surface layer e.g. of WC and a binder, an interface layer, e.g. which is a stepwise transition from the surface layer whereby the binder content thereof gradually increases, a substrate layer which is a combination of e.g. an initial high carbon steel layer and finally a base layer of bainitic steel. The composites are substantially non-porous and can be used to fabricate components such as drill bits, wear plates, pump components machine tools, seals, washers, bearings and the like.

7 Claims, No Drawings

GRADED STRUCTURE COMPOSITES

The present invention relates to a tough, wear resistant composite having a non-porous, graded structure, a process for preparation thereof and to tools and products fabricated therefrom.

The development of materials which are both tough and wear resistant is of prime importance in a wide range of engineering situations. Hitherto work in this field has primarily concentrated on searching for a combination of new components which attempt to combine these two, normally exclusive properties. Ceramics are a typical case where much effort has gone into trying to toughen inherently brittle materials. In contrast, the concept of improving the bonding between two different materials—a way of avoiding many of these problems—has received little attention.

It is known to improve the wear resistance properties of a substrate of tough engineering materials by applying a coating of hard materials thereon. A limitation with the use of such hard coatings however is the sharp interface formed by the coatings with the substrate. The sharp interface is undesirable because it can represent a high residual stress area as manufactured and can often be a site for failure on mechanical loading. Modification of the hard coating to reduce the undesirable effects of this interface frequently results in compromising its desirable properties of toughness and wear resistance. Thus, if thick coatings are used they have to be of limited wear resistance in order to ensure good bonding. On the other hand, thin coatings can be harder and more wear resistant but their lack of thickness limits them to non-abrasive applications.

The concept of graded structures is intended to be a way of avoiding these coatings problems. It is known that gradual changes in composition between the hard surface material and the tough substrate will mitigate to some extent the presence of an interface. This, in turn, reduces the residual stresses at the interface and leads to more even load distribution during service. Grading together two blocks of high quality material also reduces the problem of high defect density associated with coatings formed by the deposition technique and consequent reduction in their strength.

Thus, the present invention specifically relates to the development of tungsten carbide—steel graded structures (TCS) which mitigate these problems.

Accordingly, the present invention is a non-porous graded structure composite comprising:

A. a surface layer

A1. comprising tungsten carbide and a binder phase selected from cobalt, nickel and alloys thereof, and A2. having a thickness of 1–14% of the total thickness of the composite;

B. an interface layer comprising tungsten carbide and a binder phase as in A1 above but having a stepwise transition from the surface layer to and through the interface layer with respect to the binder content thereof such that the binder concentration in each succeeding transition step of the interface layer increases with respect to the immediately preceding transition step whereby B1. the binder content of the final transition step is no more than 50% w/w of the total tungsten carbide-binder content of that step, B2. the thickness of each transition step is from 0.5% v/v to 3% v/v of the total thickness of the composite, B3. the total thickness of the interface layer is 5–14% v/v of the total thickness of the composite, and B4. the thermal expansion coefficient of the interface layer is from $4–8\times10^{-6}$/°C. in the range of 800° C. to 250° C.; and C. a final substrate layer comprising C1. a high carbon steel layer immediately adjacent to the interface layer and which has C1.1 a substantially similar affinity for carbon to that of the preceding interface layer and which is incapable of undergoing bainitic transformation to any substantial extent under normal atmospheric cooling conditions, C1.2 a thermal expansion coefficient of $10–16\times10^{-6}$/°C. in the range of 800° C. to 250° C., and C1.3 a thickness of 0.5–3% v/v of the total thickness of the composite; and C2. a bainitic steel base layer which C2.1 has a thermal expansion coefficient of $6–10\times10^{-6}$/°C. in the range of 800° C. to 250° C., and C2.2 forms the remainder of the thickness of the composite.

By "substantially non-porous" is meant here and throughout the specification that the graded structure composite has no optically observable porosity at 400 times magnification when examining random areas of about 0.1 mm in diameter.

By bainitic steel is meant steel in the bainite phase of the type shown in the time-temperature-transformation diagram in FIG. 20.8 on page 376 of the book entitled "Introduction to Metallurgy" by A. H. Cottrell, published by Edward Arnold (Publishers) Limited, 1975, Second Edition.

The graded structure composite suitably has from 5–50% w/w of the binder phase which is preferably cobalt. The binder may contain in addition minor amounts of other metals such as e.g. Al, Cr, Ti, Mo and Fe.

The graded structure composite of the present invention is suitably produced by the conventional powder consolidation techniques such as a hot isostatic pressing (HIP) process. In this process the powders forming the respective layers are placed in the appropriate sequence in a container, e.g. a metal can which is preferably cylindrical and thus encapsulated.

The encapsulated contents of the container are subjected to four stages involving packing, decontamination, evacuation and consolidation. The consodilation. The consolidation stage embraces the HIP process.

The packing stage suitably involves uniaxial pressing of powders of the respective layers in a cylindrical container e.g. a nickel can, which are placed in the container sequentially. A packing pressure is applied to each layer (including the discrete transition steps in paragraph B above which count as separate layers for this purpose) after the powder component of that layer has been placed in the container. The pressure applied is suitably from 10 to 1000 MPa, preferably from 100 to 500 MPa. The pressure is suitably applied using a flat punch which fits into the cylindrical container. The packing step is suitably carried out at room temperature.

The packed layers are then decontaminated by sealing the container with a tight fitting lid but providing a small aperture e.g. 2 mm in diameter therein to facilitate application of vacuum. A vacuum of better than $10^{-5}$ torr at 400° C. is suitably applied for at least 5 hours to achieve decontamination. The contents of the container are then evacuated.

The evacuation step is achieved by evacuation of the container followed by sealing the container e.g. using an electron beam welder at a reduced pressure e.g. $10^{-3}$ torr. The sealing step seals both the lid and the aperture through which vacuum was applied during decontamination.

The evacuated and sealed contents of the container are then consolidated by the HIP process. In this process the container is heated to and maintained at a temperature of 1320°-1360° C. under an applied pressure which is suitably 30,000 psi (200 MPa) or greater for at least one hour. It is essential to maintain these conditions during the HIP process in order to ensure that a balance is maintained between a limited liquid phase sintering of the tungsten carbide and to avoid melting of the substrate steel layers. These conditions also restrict the mobility of the binder e.g. cobalt, thereby maintaining the discrete nature of the various layers.

The consolidation of the various layers at elevated temperature and pressure in the container is followed by cooling. The rate of cooling is suitably from 10°-200° C. per minute, preferably from 20°-100° C. per minute. The preferred cooling rate is only critical for cooling from a temperature in the region of 800° C. down to 250° C. Outside this range, from 1340° C. to 800° C. and below 250° C., the rate of cooling is not critical.

Thus, according to a further embodiment the present invention is a process for producing a substantially non-porous, graded structure composite as hereinbefore defined in paragraphs A to C above, said process comprising:

D. packing sequentially the components forming the respective layers A through C in a cylindrical container, each of the layers being compacted under pressure before introduction of the next subsequent layer, E. decontaminating the packed layers in D by sealing the container with a tight fitting lid followed by application of a vacuum through an aperture in the container or the lid, F. evacuating the decontaminated contents of the container under reduced pressure followed by sealing of the container, G. consolidating the evacuated and sealed contents of the container by a hot isostatic pressing process at a temperature from 1320°-1360° C. and a pressure at or above 30,000 psi (200 MPa) for at least one hour and H. finally cooling the consolidated product at the rate of 10° to 200° C. per minute so that the base steel layer transforms into a bainitic phase.

In carrying out the above process the particle size of the components in the various layers is suitbly from 1 to 200 microns preferably from 1 to 40 microns.

The binder content of the final transition step immediately preceding the substrate layers is suitably from 20 to 50% w/w, preferably from 20 to 30% w/w.

The base steel layer capable of undergoing bainitic transformation during cooling is preferably a steel designated as AISI 4815 having the following composition by wt %.

| Element | AISI 4815 |
|---|---|
| C | 0.13–0.18 |
| Si | 0.20–0.35 |
| Mn | 0.4–0.6 |
| Mo | 0.2–0.3 |
| Ni | 3.25–3.75 |
| S | less than 0.04 |
| P | less than 0.04 |
| Fe | balance |

Other medium carbon structural steels, typically containing 1 to 10% w/w of nickel to promote bainitic transformation can also be used.

The high carbon steel layer adjacent to the interface layer in the substrate layer is preferably of a steel designated as BO1 having the following composition in weight %.

| Element | BO1 |
|---|---|
| C | 0.85–1.0 |
| Si | less than 0.5 |
| Mn | 1.0–1.4 |
| V | less than 0.3 |
| W | 0.4–0.6 |
| Ni | less than 0.3 |
| Cr | 0.4–0.6 |
| Fe | Balance |

Instead of BO1 steels, other high carbon steels, typically the class of steels known as "tool steels" can also be used.

As for the surface layer and the interface layer standard grades of tungsten carbide containing cobalt are used. The surface layer suitably has up to 14% w/w and the interface layer suitably has 16–30% w/w of cobalt.

The present invention is further illustrated with reference to the following Example which shows the manufacture of a wear plate:

Packing: Unaxial pressing of powders (average particle size ranging from 5–40 microns) was carried out in a cylindrical nickel can of 28 mm internal diameter. Powders were introduced sequentially for each of the layers, the surface layer first and the base steel layer last, pressing to a load of 2 tons, in between measurement of each layer, with a flat ended punch of fractionally under 28 mm diameter. The interface layer had three transition steps in which the amount of cobalt in tungsten carbide increased from 16% to 20% and finally 30% w/w in the layer adjacent to the high carbon steel layer. Each transition step had a thickness of about 0.8 mm. When solid the layer thicknesses were:

Surface layer, 4 mm tungsten carbide containing 14% w/w cobalt

Interfacelayer, 2.5 mm tungsten carbide containing 16–30% w/w cobalt

High carbon content steel layer, 1 mm BO1 steel

Bainitic steel base layer, 21 mm AISI 4815 steel.

Initial powder thicknesses were × 1.2 prior to consolidation

Decontamination: The cylindrical can was sealed with a tight fitting lid provided with a small (ca 2 mm) central aperture and then subjected to a vacuum of better than $10^{-5}$ torr at 400° C. for 5 hours.

Evacuation: The can was then evacuated and sealed using an electron beam welder at $10^{-3}$ torr. Both the lid and the aperture in the lid were sealed.

Consolidation: The evacuated and sealed can was then hot isostatically pressed at 1340° C.±10° C. and 30,000 psi for about 1 hour, held at that temperature for about 1 hour and then cooled at a cooling rate of ca 70° C. per minute in the temperature range from 800° C. down to 250° C.

The physical properties of the resultant product composite are tabulated below:

Porosity - non-observable optically at 400 times magnification under a microscope.

| | Vickers Hardness | Bend Strength (MPa) |
|---|---|---|
| Surface layer | 1050 | 3100 |
| Interface layer | 910–620 | 3000–2600 |
| High carbon steel layer | 550 | 2100 |
| Bainitic steel base layer | 300 | 1500 |

The non-porous graded structure composites of the present invention can be used for the fabrication of any of the following:

Rock drilling equipment and drill bits, wear plates, slurry pump components, armour piercing projectiles, metal machining tool tips, sliding seals, thrust washers, bearings and general engineering use where a combination of good wear resistance and good toughness are required.

We claim:

1. A non-porous graded structure composite comprising:

A. a surface layer

A1. comprising tungsten carbide and a binder phase selected from cobalt, nickel and alloys thereof, and A2. having a thickness of 1–14% of the total thickness of the composite;

B. an interface layer comprising tungsten carbide and a binder phase as in A1 above but having a stepwise transition from the surface layer to and through the interface layer with respect to the binder content thereof such that the binder concentration in each succeeding transition step of the interface layer increases with respect to the immediately preceding transition step whereby B1. the binder content of the final transition step is no more than 50% w/w of the total tungsten carbide-binder content of that step, B2. the thickness of each transition step is from 0.5% v/v to 3% v/v of the total thickness of the composite, B3. the total thickness of the interface layer is 5–14% v/v of the total thickness of the composite, and B4. the thermal expansion coefficient of the interface layer is from $4–8\times10^{-6}$/°C. in the range of 800° C. to 250° C.; and C. a final substrate layer comprising C1. a high carbon steel layer immediately adjacent to the interface layer and which has C1.1 a substantially similar affinity for carbon to that of the preceding interface layer and which is incapable of undergoing bainitic transformation to any substantial extent under normal atmospheric cooling conditions, C1.2 a thermal expansion coefficient of $10–16\times10^{-6}$/°C. in the range of 800° C. to 250° C., and C1.3 a thickness of 0.5–3% v/v of the total thickness of the composite; and C2. a bainitic steel base layer which C2.1 has a thermal expansion coefficient of $6–10\times10^{-6}$/°C. in the range of 800° C. to 250° C., and C2.2 forms the remainder of the thickness of the composite.

2. A graded structure composite according to claim 1 said composite comprising from 5–50% w/w of the binder phase in A1.

3. A graded structure composite according to claim 1 wherein the binder phase in A1 is cobalt.

4. A graded structure composite according to claim 1 wherein the surface layer A has up to 14% w/w of cobalt and the interface layer B has 16–30% w/w of cobalt.

5. A graded structure composite according to claim 1 wherein the binder content of the final transition step is from 20–50% w/w.

6. A graded structure composite according to claim 1 wherein the high carbon steel layer C1 i either a steel designated BO1 or a tool steel.

7. A graded structure composite according to claim 1 wherein the bainitic base steel layer C2 capable of undergoing bainitic transformation is either a steel designated AISI 4815 or a structural steel containing 1–10% w/w of nickel.

* * * * *